US006649851B1

(12) United States Patent
Hennel et al.

(10) Patent No.: US 6,649,851 B1
(45) Date of Patent: Nov. 18, 2003

(54) BLOCKING DEVICE FOR SWITCH MECHANISM

(75) Inventors: Paul Hennel, Wenzenbach (DE); Reinhard Schweiger, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/030,873

(22) PCT Filed: Apr. 7, 2000

(86) PCT No.: PCT/DE00/01078

§ 371 (c)(1),
(2), (4) Date: Oct. 19, 2001

(87) PCT Pub. No.: WO00/63931

PCT Pub. Date: Oct. 26, 2000

(30) Foreign Application Priority Data

Apr. 20, 1999 (DE) ..... 199 17 859

(51) Int. Cl.[7] ..... H01H 9/28

(52) U.S. Cl. ..... 200/43.14; 200/43.15; 200/43.16; 200/43.13

(58) Field of Search ..... 200/43.14, 43.15, 200/43.16, 43.01, 43.2, 43.21, 43.22, 43.13

(56) References Cited

U.S. PATENT DOCUMENTS 5,079,390 A 1/1992 Costanzo et al.
5,300,740 A 4/1994 Benda
5,310,969 A 5/1994 Turek et al.
5,593,020 A * 1/1997 Alexander ..... 200/43.14
5,817,999 A * 10/1998 Mugan et al. ..... 200/50.11

FOREIGN PATENT DOCUMENTS

| | | | |
|---|---|---|---|
| DE | 29 140 88 C3 | | 10/1979 |
| DE | 92 01 409 U | | 6/1993 |
| DE | 693 12 892 T2 | | 6/1994 |
| EP | 0 172 771 A1 | | 2/1986 |
| EP | 0 604 331 A1 | * | 6/1994 |
| GB | 2 285 887 A | | 7/1995 |
| WO | 97/43776 | | 11/1997 |

* cited by examiner

*Primary Examiner*—Elvin Enad
*Assistant Examiner*—Jennifer A. Poker
(74) *Attorney, Agent, or Firm*—Harness, Dickey & Pierce, P.L.C.

(57) ABSTRACT

A blocking mechanism is used for switching devices. The manual control element of the blocking mechanism can be locked against unauthorized actuation. The blocking mechanism is able to be blocked such that it cannot be detached. Retaining elements can be moved in relation to each other in a guide, and can engage with retaining lugs in recesses of a switching device to be locked. A catch element locks the actuation of the retaining elements in predetermined retaining positions in its engaged position.

22 Claims, 9 Drawing Sheets

BLOCKING DEVICE FOR SWITCH MECHANISM

DESCRIPTION

Figure 1:
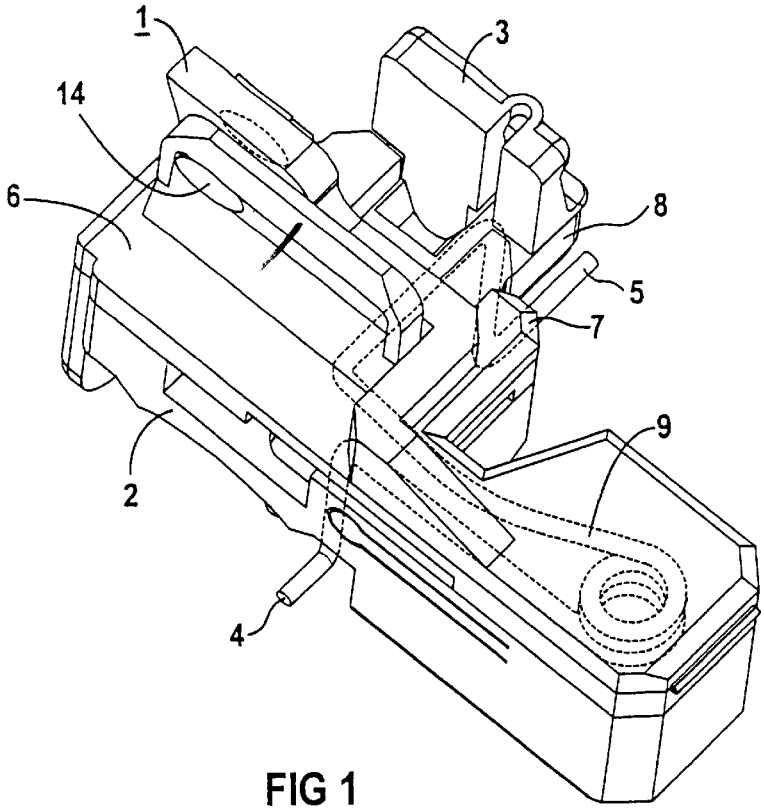

The invention is based on the object of developing a blocking mechanism for switching devices which makes it possible to arrest switching devices of different widths with regard to their manual control element with a blocking mechanism in a simple way. The solution achieving the object described is provided by a blocking mechanism.

There are a wide variety of blocking mechanisms on the market. For instance, it is known to clamp a switch knob, as a manual control element, with a type of clamp which bears flat against the switching device, it being possible for the clamping screw to be blocked against loosening by a latching mechanism (U.S. Pat. No. 5,079,390). In comparison with box-like formations which block access to the manual control element, the known configuration makes it possible to secure switching devices against inadmissible operation independently of their width. However, the known blocking mechanism must be produced from strong material, such as metal, since relatively great forces have to be absorbed internally. EP 0 172 771 A1 discloses, furthermore, a device for locking a miniature circuit-breaker according to the precharacterizing clause of claim 1.

Metallic materials in the area of the manual control element do not meet the relevant safety requirements in the case of all configurations of protective switching devices.

The invention is based on the object of developing a blocking mechanism for switching devices which makes it possible by a different means to arrest switching devices of different widths with regard to their manual control element with a blocking mechanism in a simple way.

The solution achieving the object described is provided by a blocking mechanism as claimed in claim 1.

The retaining lugs may in this case engage in sealing holes of the switching device or protective switching device which are usually present in any case. A blocking mechanism of this type can be produced from insulating plastic, and it can be designed and used for a plurality of devices with manual control elements of different widths.

One retaining element may form a carriage guide in which a carriage formed with respect to the other retaining element is guided under spring action. The retaining elements may also be guided in each other in the manner of a collet guide and have a torsion spring for the spring action.

The retaining elements may also be movably guided in relation to each other by a telescopic guide under spring action.

In the case of all these solutions, the spring providing the spring action may form the retaining lugs with its ends. In the case of the configurations mentioned, the catch element may engage with a tooth in a respective recess for each position in the guide of the retaining elements, whereby the retaining elements are locked in the desired position.

The catch element may be respectively attached in an articulated manner on one of the retaining elements by a film gate hinge.

According to another alternative, the retaining elements may be held in the respective retaining position by exchangeable shackle springs, the catch element being designed such that it can swivel into the shackle. The spring ends may be made to match the width of the switching device respectively to be blocked by the spring ends being of different lengths.

Finally, the guide of the retaining elements may be designed as a post which engages in a cylindrical hole of a retaining element.

The post may be surrounded by a cylindrical spring for the spring action.

According to a further configuration, the retaining elements may be held in the retaining position by exchangeable horizontal shackle springs of different widths, the catch element being provided with grooves which in the locking position receive the legs of the springs of different widths and consequently lock the retaining elements.

The invention is now to be explained in more detail on the basis of exemplary embodiments reproduced in the drawing:

Reproduced in FIG. 1 in a perspective and partly schematic form is a blocking mechanism in which the retaining elements are guided in each other in the manner of a carriage guide under spring action, the spring being made in the form of a torsion spring.

Figure 2:
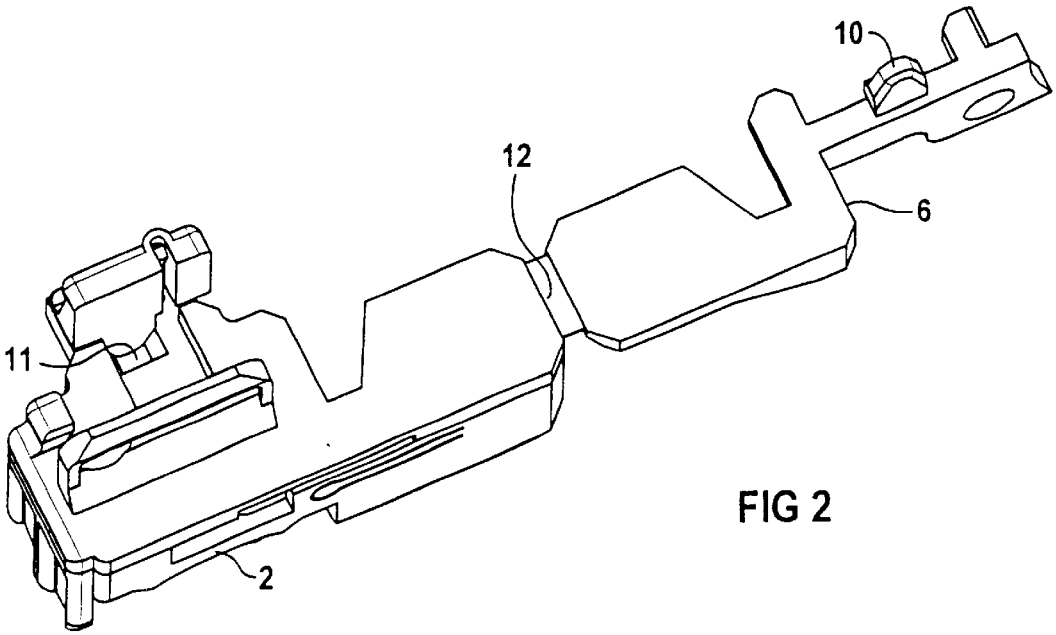

Illustrated in FIG. 2 is the blocking mechanism according to FIG. 1 with the catch element swung open, in which mechanism the retaining elements are consequently not locked and can be pressed together in order to be inserted with their retaining lugs into the sealing holes of a switching device.

Figure 3:
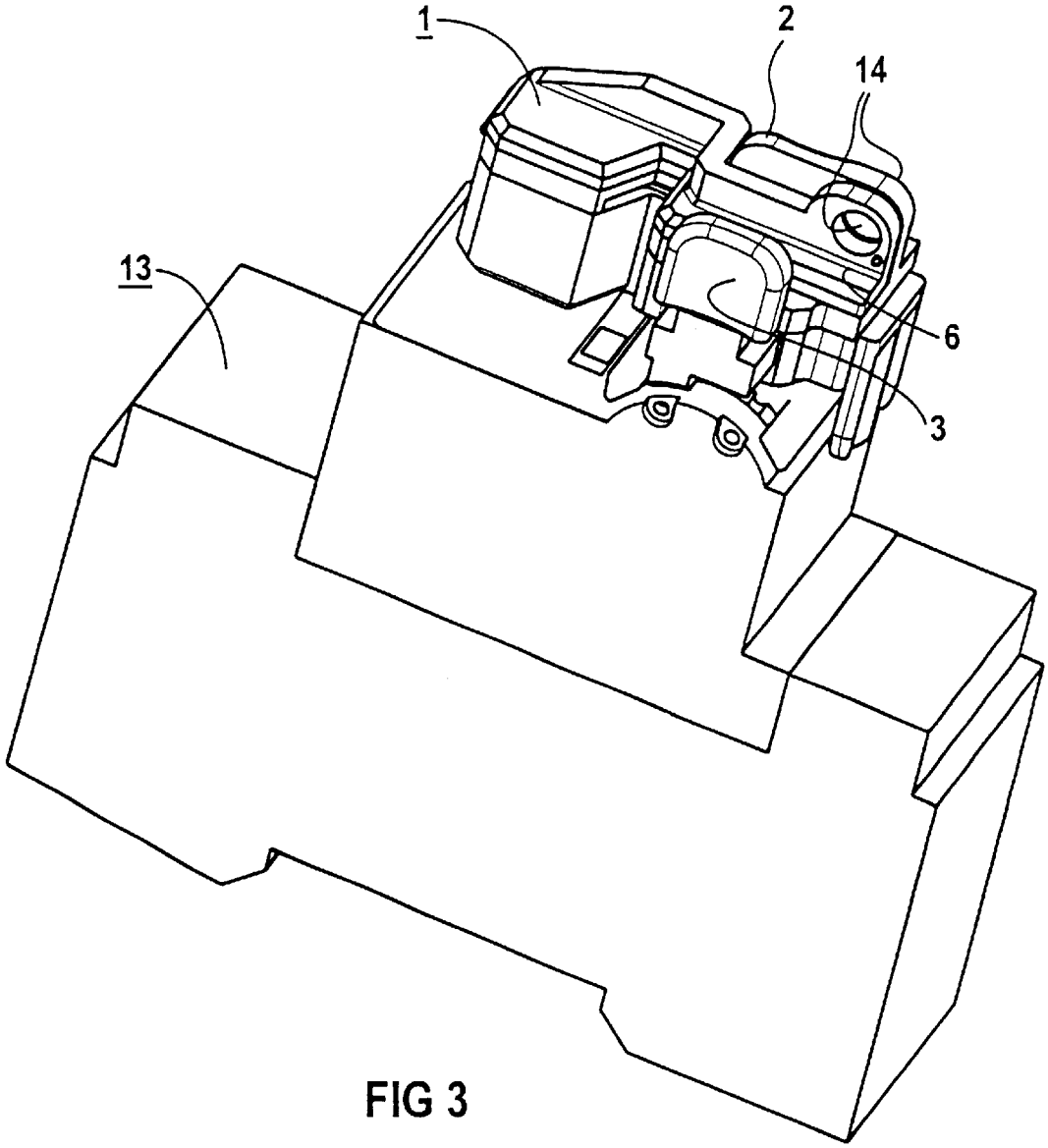

Illustrated in a perspective representation in FIG. 3 is the blocking mechanism according to FIGS. 1 and 2 after fitting on a switching device.

Figure 4:
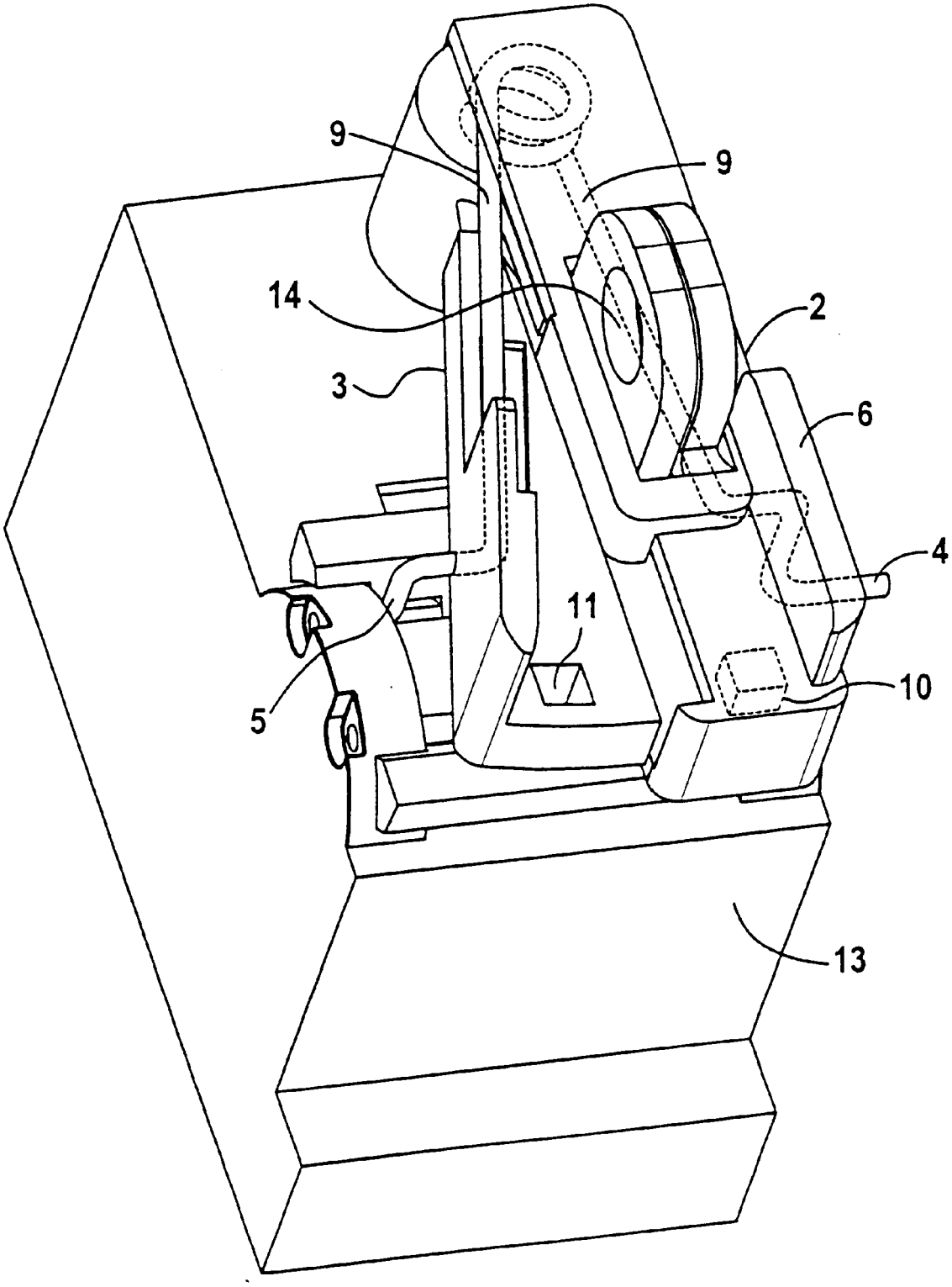

Reproduced in FIG. 4 is another exemplary embodiment of the blocking mechanism, according to which the retaining elements are guided one in the other in the manner of a collet guide. They have a torsion spring for the spring action.

Figure 5:
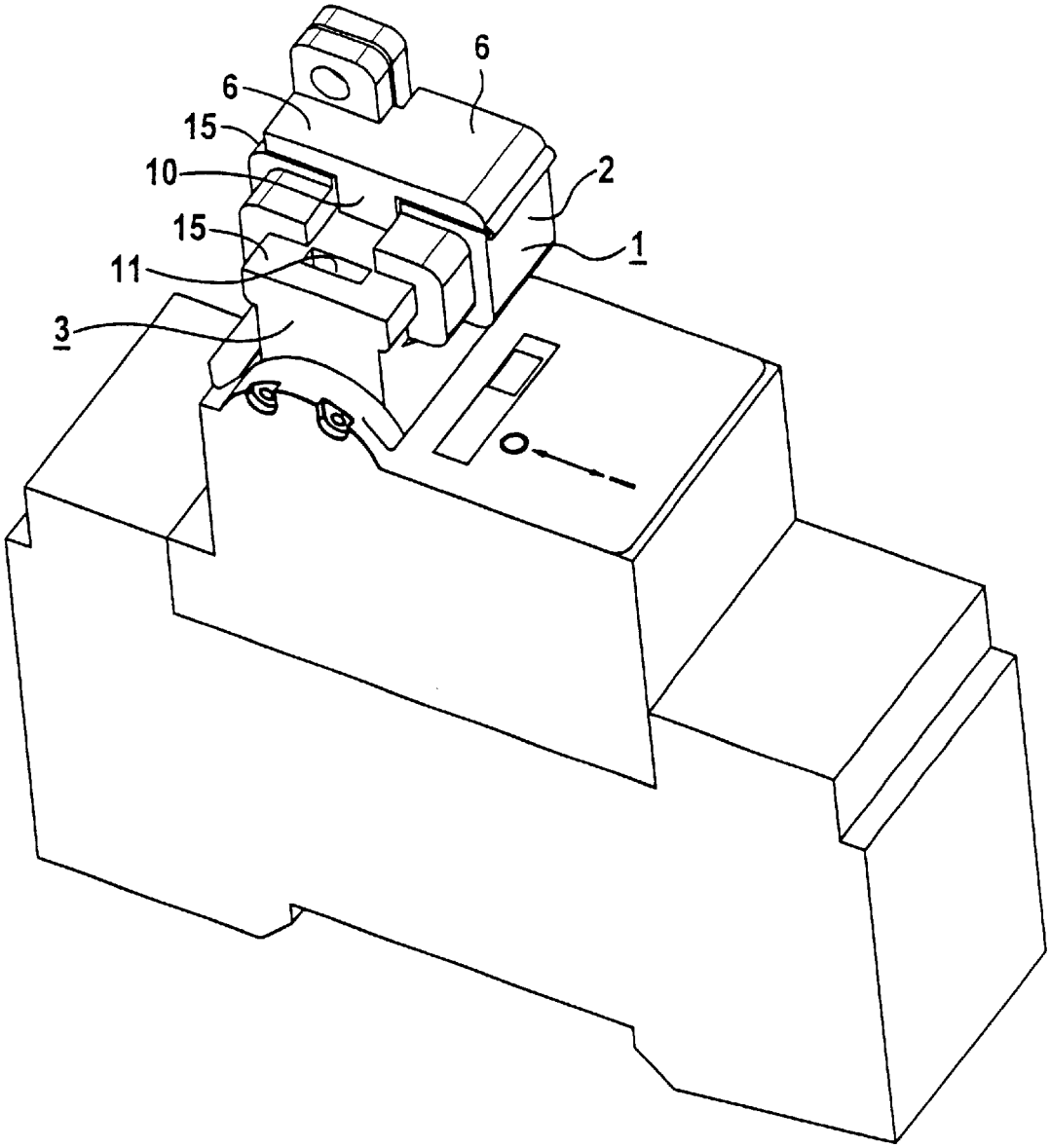

Represented in FIG. 5 is a further exemplary embodiment, in a perspective form and mounted on a wide switching device. The retaining elements are in this case movable in relation to each other by a telescopic guide and in a practical way under the action of a spring.

Figure 6:
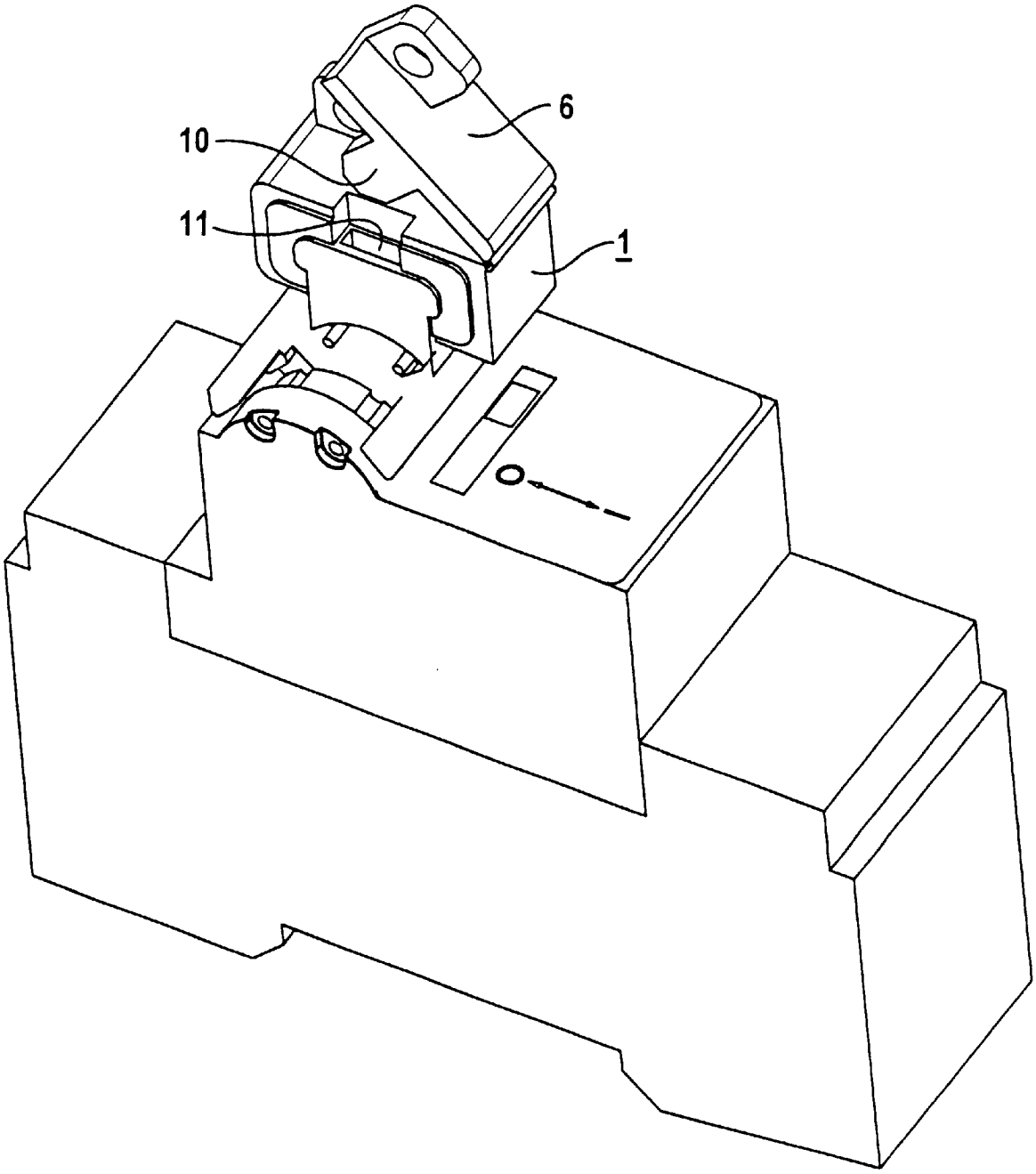

In FIG. 6, the blocking mechanism according to FIG. 5 has been pressed together and is illustrated with the catch element open. The blocking mechanism could be fitted, in this state, on a narrow switching device.

Figure 7:
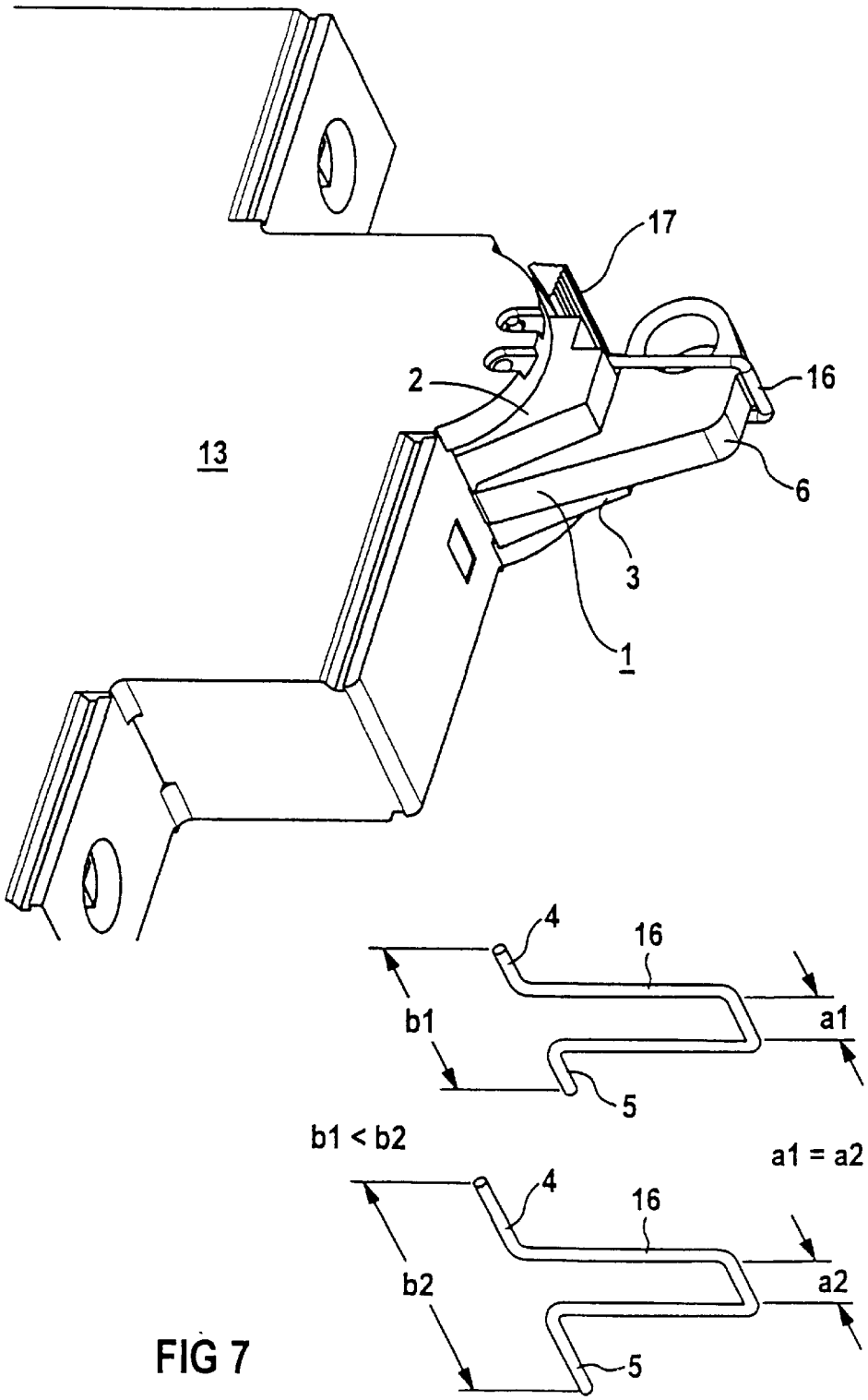

Illustrated in FIG. 7 is the blocking mechanism according to a further exemplary embodiment. The retaining elements of the blocking mechanism are retained here in their respective retaining position by exchangeable shackle springs. The two shackle springs, represented separately in FIG. 7, are of the same length at the back, but the ends of the shackle springs are of different widths at the base. In this way, an adaptation to switching devices of respectively corresponding widths is achieved.

Figure 8:
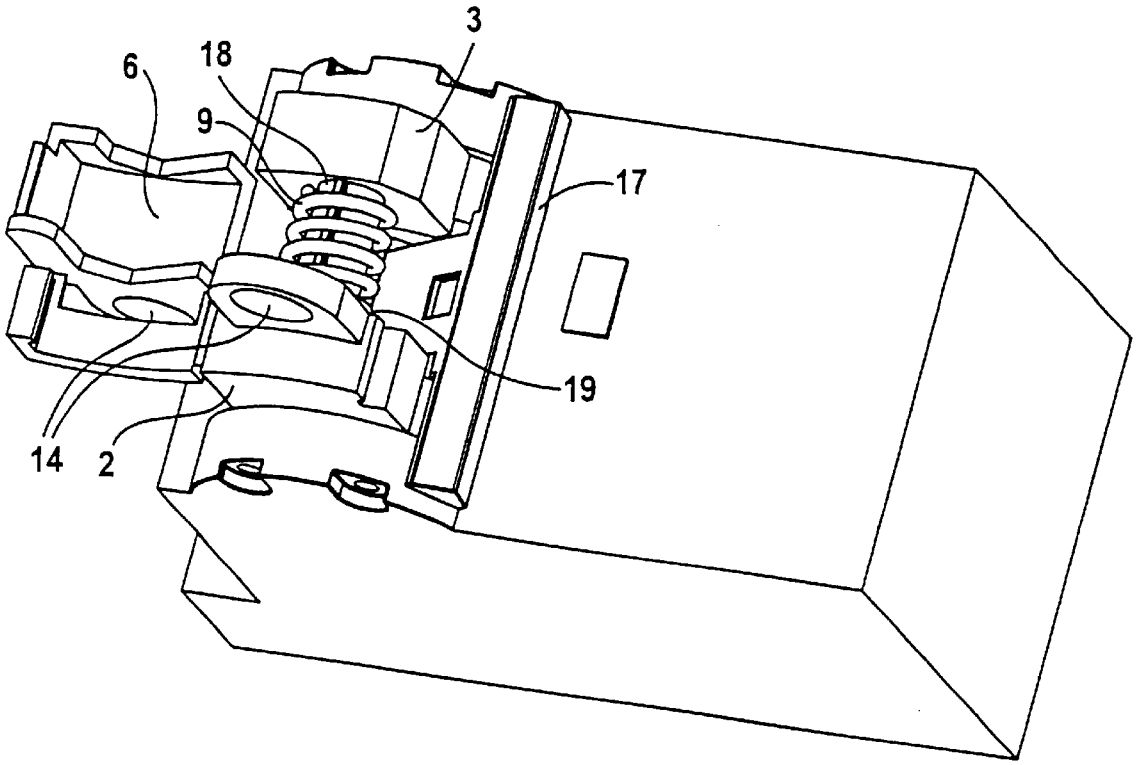

Reproduced in FIG. 8 is a further exemplary embodiment of the blocking mechanism on a wide switching device, according to which the guide of the retaining elements is designed as a post which engages in a cylindrical hole of one of the retaining elements. Serving here for spring action is a cylindrical spring, which is arranged over the post. The catch element is open.

Figure 9:
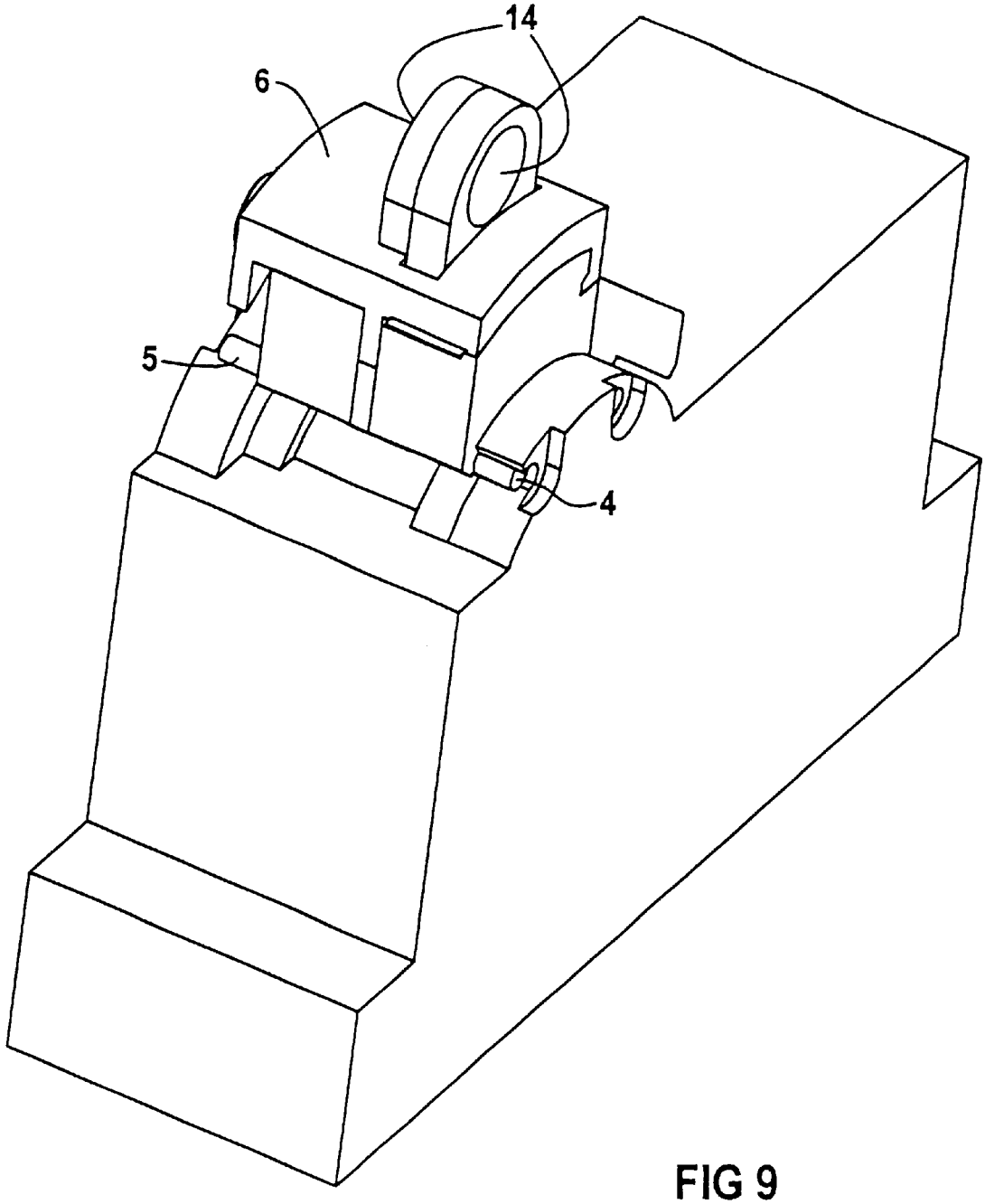

Reproduced in FIG. 9 is the blocking mechanism according to FIG. 8 with the catch element closed, on a narrow switching device.

Figure 10:
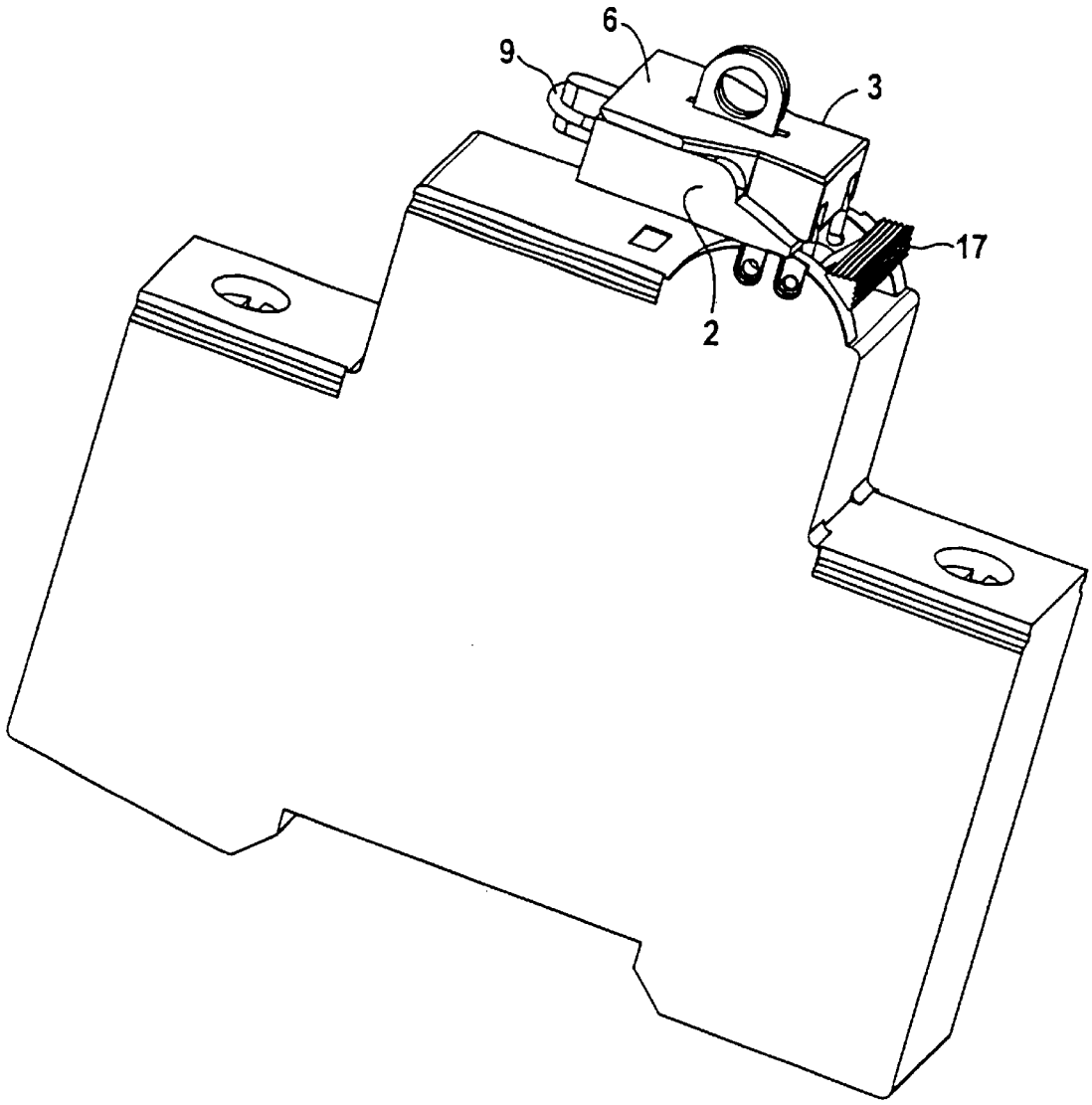

The blocking mechanism in the exemplary embodiment according to FIG. 10 has retaining elements which are retained in their retaining position by exchangeable horizontal shackle springs of different widths. The catch element is provided with grooves which, in the locking position, receive the legs of the springs of different widths and lock the retaining elements in this position.

The blocking mechanism 1 according to FIG. 1 has retaining elements 2, 3, which can engage with retaining lugs 4, 5 in recesses of a switching device to be locked, a catch element 6 blocking the actuation of the retaining elements 2, 3 in intended retaining positions in its engaged position. The retaining element 2 forms a carriage guide in which a carriage 8 formed on the other retaining element 3 is guided under spring action. In the exemplary embodiment, the drive spring 9 is designed as a torsion spring. The spring 9 for the spring action forms the retaining lugs 4 and 5 with its ends. These fit in the sealing holes present in any case in switching devices.

The catch element 6, compare FIG. 2, has in the exemplary embodiment a tooth 10, which can engage in the guide of the retaining elements according to the intended position of the retaining elements and lock the retaining elements. The catch element 6 is attached in an articulated manner on the retaining element 2 by a film gate hinge 12.

The blocking mechanism 1 according to FIGS. 1 and 2 is illustrated in FIG. 3 in the state of being mounted on a switching device 13. In the swung-in state of the catch element 6, the retaining element 2 is in line with a recess 14, through which a shackle lock can be hooked in order to block the locked retaining elements and thereby arrest the manual control element of the switching device 13. This arrestment can take place by access to the manual control element being denied or by the blocking mechanism bearing against the manual control element in a switching position in such a way that the manual control element can no longer be actuated.

Illustrated in FIG. 4 is another exemplary embodiment of the blocking mechanism in the state of being mounted on a switching device 13, the retaining elements 2, 3 of said mechanism being guided one in the other in the manner of a collet guide and having a torsion spring as the drive spring 9. The retaining elements 2, 3 may enclose the legs of the torsion spring by a casting technique. In this exemplary embodiment, the retaining lugs 4 and 5 are again formed by the ends of the drive spring. The catch element 6 again has a tooth 10, with which it can engage in recesses 11, in desired positions, in the guide of the retaining elements or in the retaining elements and can thereby lock the return elements in the desired predetermined positions.

In the exemplary embodiment according to FIG. 5, the blocking mechanism 1 is provided with retaining elements which are movably guided in relation to each other by a telescopic guide 15. A catch element 6 may again engage with a tooth 10 in assigned recesses 11, in order to lock the return elements in desired positions. These positions are assigned to switching devices of different widths.

In FIG. 6, the blocking mechanism 1 according to FIG. 5 is illustrated with the catch element 6 raised and the telescopic guide pushed together.

In the exemplary embodiment according to FIG. 7, the retaining elements 2, 3 are retained in their respective retaining position by exchangeable shackle springs 16, the catch element 6 being designed such that it can be swivelled into the shackle. The spring ends at the base of the shackle springs are of different lengths and form the retaining lugs 4, 5 of different lengths. This allows to the blocking mechanism 1 to be adapted to switching devices 13 of different widths. Since manual control element 17 is arrested by the blocking mechanism according to FIG. 7 by the blocking mechanism bearing against it in the switching position to be arrested.

In the exemplary embodiment according to FIG. 8, the guide of the blocking mechanism is designed as a post 18, which engages in a cylindrical hole 19 of one of the retaining elements. The post 18 for the guide is surrounded by a cylindrical spring as a drive spring 9. In FIG. 8, the catch element 6 is illustrated in the open state and in FIG. 9 it is illustrated in the closed state. Spring ends may again form the retaining lugs 4, 5.

Represented in FIG. 10 is a further exemplary embodiment of the blocking mechanism 1. The retaining elements 2 and 3 are acted upon by exchangeable horizontal shackle springs as the drive spring 9. Springs of different widths and corresponding grooves for the legs of these springs in the catch element 6 allow the retaining elements to be locked in the respectively desired retaining position. Instead of springs of different widths, a shackle spring may also be allowed to diverge to correspondingly different widths and be retained in desired positions by a catch element with correspondingly differently inclined grooves.

What is claimed is:

1. A blocking mechanism to prevent unauthorized actuation of a manual operating element of a switching device, comprising:

a first retaining element;

a catch element attached on the first retaining element in an articulated manner;

a first and a second resilient retaining lug for engagement in recesses of the switching device, at least one retaining lug being actuable; and a second separate retaining element, for the actuation of the retaining lug, the two retaining elements being guided in relation to each other, and the two retaining elements being locked in relation to each other by the catch element to prevent actuation in a retaining position.

2. The blocking mechanism as claimed in claim 1, wherein the first retaining element forms a carriage guide, in which a carriage formed on the second retaining element is guided under spring action.

3. The blocking mechanism as claimed in claim 1, wherein the retaining elements are guided one in the other in the manner of a collet guide and have a torsion spring for spring action.

4. The blocking mechanism as claimed in claim 1, wherein the retaining elements are guided movably in relation to each other by a telescopic guide.

5. The blocking mechanism as claimed in claim 1, wherein the retaining elements are retained in a respective retaining position by exchangeable shackle springs, the catch element being designed such that it can be swiveled into the shackle, the shackle spring including spring ends, which form the retaining lugs of different lengths.

6. The blocking mechanism as claimed in claim 1, wherein a post, which engages in a cylindrical hole of at least one retaining element, is formed for guiding the two retaining elements, the post being surrounded by a cylindrical spring as a drive spring.

7. The blocking mechanism as claimed in claim 1, wherein the retaining elements are each retained in a respective retaining position by exchangeable horizontal shackle springs as drive springs of different widths, the catch element being provided with grooves, which in a locking position of the retaining elements, receive legs of the springs of different widths and lock the retaining elements.

8. The blocking mechanism as claimed in claim 1, wherein the drive spring forms the retaining lugs with its ends.

9. The blocking mechanism as claimed in claim 1, wherein the catch element is engagable with a tooth in a respective recess for each position in a guide of the retaining elements, to lock the retaining elements.

10. The blocking mechanism as claimed in claim 1, wherein the catch element is attached in an articulated manner on one of the retaining elements by a film gate hinge.

11. The blocking mechanism as claimed in claim 2, wherein the drive spring forms the retaining lugs with its ends.

12. The blocking mechanism as claimed in claim 3, wherein the drive spring forms the retaining lugs with its ends.

13. The blocking mechanism as claimed in claim 4, wherein the drive spring forms the retaining lugs with its ends.

14. The blocking mechanism as claimed in claim 5, wherein the drive spring for forms the retaining lugs with its ends.

15. The blocking mechanism as claimed in claim 2, wherein the catch element is engagable with a tooth in a respective recess for each position in the guide of the retaining elements, to lock the retaining elements.

16. The blocking mechanism as claimed in claim 3, wherein the catch element is engagable with a tooth in a respective recess for each position in the guide of the retaining elements, to lock the retaining elements.

17. The blocking mechanism as claimed in claim 4, wherein the catch element is engagable with a tooth in a respective recess for each position in a guide of the retaining elements, to lock the retaining elements.

18. The blocking mechanism as claimed in claim 5, wherein the catch element is engagable with a tooth in a respective recess for each position in a guide of the retaining elements, to lock the retaining elements.

19. The blocking mechanism as claimed in claim 2, wherein the catch element is attached in an articulated manner on one of the retaining elements by a film gate hinge.

20. The blocking mechanism as claimed in claim 3, wherein the catch element is attached in an articulated manner on one of the retaining elements by a film gate hinge.

21. The blocking mechanism as claimed in claim 4, wherein the catch element is attached in an articulated manner on one of the retaining elements by a film gate hinge.

22. The blocking mechanism as claimed in claim 5, wherein the catch element is attached in an articulated manner on one of the retaining elements by a film gate hinge.

* * * * *